United States Patent [19]

Musall et al.

[11] 4,432,943

[45] * Feb. 21, 1984

[54] ELASTIC SUSPENSION FOR A MONOLITHIC CATALYST BODY IN A EXHAUST GAS CLEANING DEVICE

[75] Inventors: Reimar Musall, Burgdorf; Wilhelm Wolsing, Hanover, both of Fed. Rep. of Germany

[73] Assignee: Kali-Chemie AG, Hanover, Fed. Rep. of Germany

[ * ] Notice: The portion of the term of this patent subsequent to May 4, 1999 has been disclaimed.

[21] Appl. No.: 578,712

[22] Filed: May 19, 1975

Related U.S. Application Data

[63] Continuation of Ser. No. 376,338, Jul. 5, 1973, Pat. No. 4,328,187.

[30] Foreign Application Priority Data

Jul. 10, 1972 [DE] Fed. Rep. of Germany ..... 2233886

[51] Int. Cl.[3] ..... F01N 3/15; B01J 8/02

[52] U.S. Cl. ..... 422/179; 422/180

[58] Field of Search ..... 422/179, 180; 55/DIG. 30

[56] References Cited

U.S. PATENT DOCUMENTS

| | | | |
|---|---|---|---|
| 3,227,242 | 1/1966 | Mattoon | 422/198 X |
| 3,248,188 | 4/1966 | Chute | 422/168 X |
| 3,441,381 | 4/1969 | Keith et al. | 422/179 X |
| 3,692,497 | 9/1972 | Keith et al. | 422/179 |
| 3,798,006 | 3/1974 | Balluff | 422/179 |
| 3,854,888 | 12/1974 | Frietzshe et al. | 422/179 X |

*Primary Examiner*—Barry S. Richman

*Attorney, Agent, or Firm*—Schwartz, Jeffery, Schwaab, Mack, Blumenthal & Koch

[57] ABSTRACT

A catalyzer for detoxifying exhaust gases from an internal combustion engine wherein a monolithic catalyst body is supported within a housing having a composite damping arrangement placed in the housing between the catalyst body and the housing walls and having a portion extending axially of the catalyst body for damping radial forces acting on the body, and end portions for damping axial forces acting on the catalyst body, means cooperating with the damping means for elastically suspending the catalyst body in the housing and protecting rings positioned between the elastic holder and the catalyst body to further protect the edges of the catalyst body against destructive forces thereon.

14 Claims, 3 Drawing Figures

ELASTIC SUSPENSION FOR A MONOLITHIC CATALYST BODY IN A EXHAUST GAS CLEANING DEVICE

CROSS-REFERENCE TO OTHER APPLICATIONS

This is a Continuation of co-pending application Ser. No. 376,338, filed July 5, 1973, now U.S. Pat. No. 4,328,187 of May 4, 1982.

FIELD OF THE INVENTION

The present invention relates to an elastic suspension for ceramic monolithic bodies, and more particularly it relates to the suspension of such monolithic bodies which are used as catalyst carriers preferably in devices for the decontamination of exhaust gases of automobiles.

BACKGROUND OF THE INVENTION

The use of ceramic catalyst carriers having a honeycomb structure for the cleaning of exhaust gases, especially for the cleaning of the exhaust gases of automobiles, has been already known. Such honeycomb structures combine two advantages. On one hand they possess a large surface with respect to a unit volume, on the other the flow resistance through them is very small. The difficulty of their use in devices for the decontamination of exhaust gases of automobiles resides in their required elastic suspension. The pushing forces and vibrations which occur during the travelling of the car, place a heavy mechanical requirement on the honeycomb structure so that finally this will lead to a destruction of the catalyst carrier.

Elastic suspension for such honeycomb structures have been already proposed, such as by U.S. Pat. No. 3,441,382, which describes a catalyst patron which consists of a ceramic monolithic catalyst element placed in a metallic housing and in which, between the catalyst and the housing wall, a heat insulating mass, such as fire resistant brick, or molten aluminum oxide, etc., is placed. By means of a metallic spring, which can be adjusted, a pressure is applied to the insulating mass so that the catalyst body is retained fixedly in its position. Such suspension turned out to be, however, not sufficiently elastic. The pressure applied to the body of the catalyst is too large and is not uniformly distributed in order to be able to prevent a gradual mechanical destruction of the honeycomb structure.

Another device for the catalytic decontamination of the exhaust gases of automobiles has been described in German DAS No. 1,476,507. In such a device the monolithic catalyst is placed in a cylindrical housing between a pair of annular flanges which are in gas-tight connection with the housing. Into the annular gap between the housing and the catalyst a resilient wavy member is placed which can be in form of a corrugated or wavy wire mesh which surrounds the catalyst body very tightly.

The experience of the automobile industry, especially in the case of high revolution four-cycle engines, proves that the wavy-shaped wire mesh inserts cannot withstand the high thermal and mechanical stress even when the wire mesh is made from a high heat-resistant steel. The ceramic body which is embedded in the wire mesh begins to wander around within it when the gripping effect of the wire mesh has lost its original tight application. Then due to the subsequent large shaking and oscillating forces the ceramic body will become quickly destroyed.

SUMMARY OF THE INVENTION

It is therefore an object of the present invention to provide an improved elastic suspension for a ceramic body of the monolithic type preferably used as a catalyst carrier in an exhaust gas cleaning arrangement for automobiles which is capable to withstand the severe shocks and oscillating forces arising during the travelling of the vehicle.

The present invention provides an apparatus for cleaning exhaust gases preferably for motor vehicles comprising a rigid housing forming an outer wall of the exhaust gas conduit, a shock sensitive catalyst body of the monolithic type being placed for suspension axially within the housing, damping elements placed in the housing between the catalyst body and the housing surrounding partially the catalyst body for damping radial forces acting on the body, and end portions protruding beyond the end faces of the catalyst body and covering a ring shaped area of the end faces of the catalyst body for damping axial forces acting on the catalyst body, and means cooperating with the damping means for suspending the catalyst body in said housing. An annular space is defined by the inner wall of the housing and the catalyst body.

BRIEF DESCRIPTION OF THE DRAWINGS

The invention will become more readily apparent from the following description of preferred embodiments thereof shown in the accompanying drawings, in which.

DESCRIPTION OF THE PREFERRED EMBODIMENTS

Figure 1:
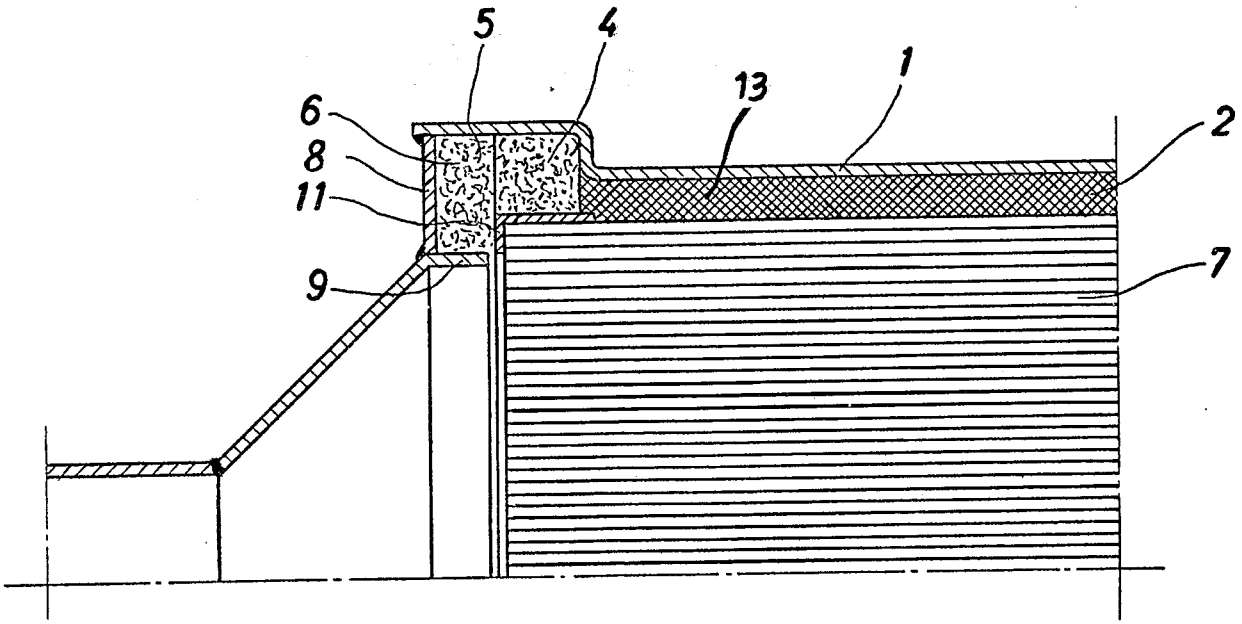
FIG. 1 is a longitudinal section of one quarter of the symmetrical housing containing the catalyst body and its elastic suspension according to the present invention.

The apparatus including the inventive suspension for the preferably honeycomb structured shock sensitive catalyst body 7 within an exhaust gas cleaning arrangement as it can be seen in FIG. 1 includes a metallic housing 1 which is rigid and is closed at other portions than at the two ends thereof for the entry and exit of the exhaust gases thereto. As can also be seen in FIG. 1 the annular space 13 between the housing and the catalyst body is filled with a heat resistant mineral fiber material 2. The main function of this mineral fiber layer is to prevent any by-pass of the exhaust gas. Furthermore it serves as a thermal isolation.

An end chamber 5 is formed between the housing wall 1 and collar 9, angular ring 11 and end wall 8, which contains the resilient cushion 6 being shaped as an annular ring and covering a ring shaped area of the end faces of the catalyst body for damping axial forces acting on the catalyst body. Chamber 5 is outside the gas stream. The damping element 4 surrounding the catalyst body 7 is in the form of an annular cushion 4 and placed adjacently to the cushion 6 and serves for damping radial forces acting on the catalyst body. The material of the cushions 4 and 6 must be highly elastic such as foamed asbestos, a glass fiber fleece or preferably a metallic wire mesh. It is noted that the longitudinal section of the cushions 6 and 4 is formed as an L. The cushions may consist of one integral part.

An angular ring 11 between catalyst body 7 and cushions 6 and 4 is provided for the protection of catalyst body 7 against the relative movement of the ring shaped cushions during occurence of axial and radial compression forces. This angular ring may consist of two or more elements.

Figures 2, 3:
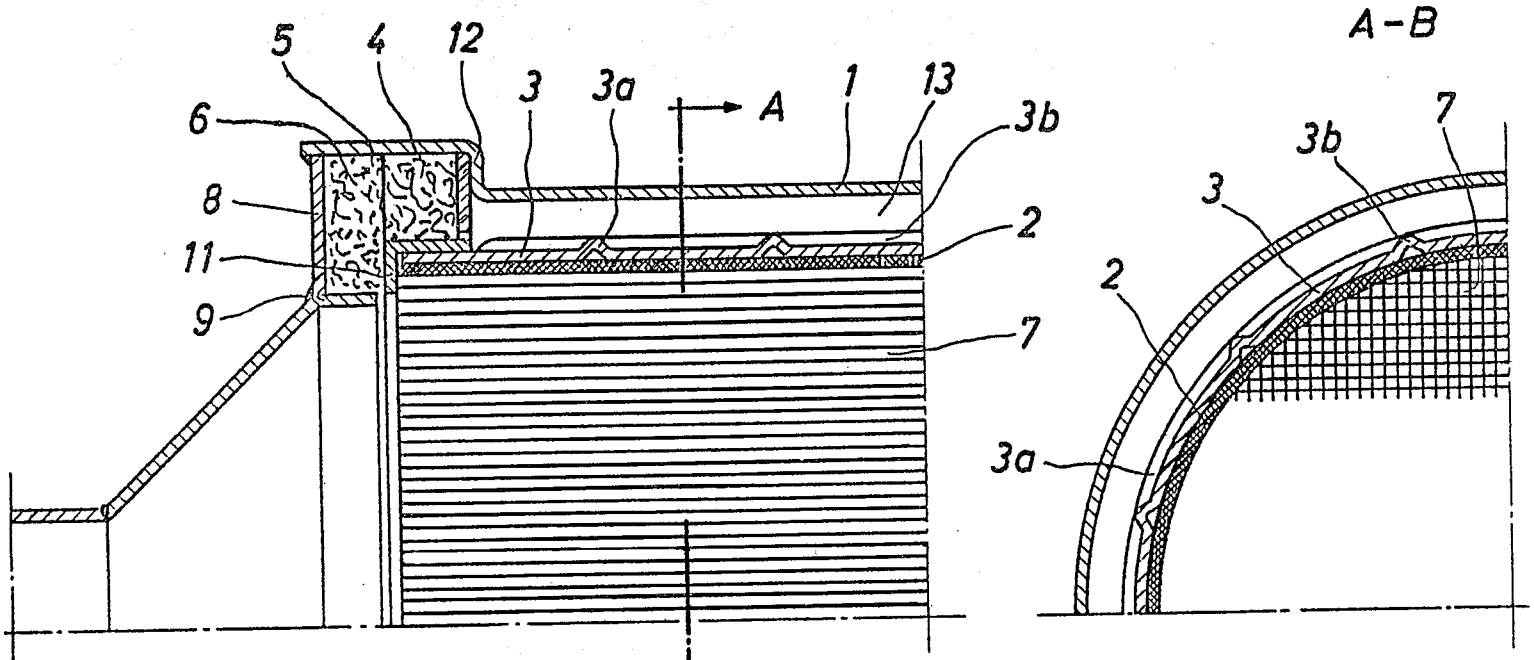
FIG. 2 is the corresponding longitudinal section through an alternative embodiment of the invention.
FIG. 3 is a cross section along line A-B in FIG. 2.

With reference to FIG. 2 the catalyst body is surrounded by a mineral fiber layer 2 for compensating geometric deviations of the catalyst body. A rigid sleeve 3 is provided consisting of heat resistant metal in the form of a closed cylinder which can have a longitudinal slot made therein or consisting of a pair of halves or several sections. The sleeve 3 can be made to have ribs 3*a* circumferentially or also longitudinally 3*b* in order to provide for additional stiffening of the sleeve 3. At the end of the structure according to FIG. 2 an end chamber 5 is formed through the cooperation of the wall portions of the housing 1, wall portion 8 and collar 9 as well as angular ring 11 which is formed in the indicated angular fashion for axially restraining the end of the catalyst body 7 and sleeve 3. Angular ring 11 has the same function as in the embodiment of FIG. 1. The end of the chamber 5 is sealed off by an annular disc 12. The chamber 5 contains the damping cushions 4 and 6 as in the embodiment according to FIG. 1. It is seen that between sleeve 3 and the outer wall 1 of the housing an annular space 13 is formed which can be void or can be filled with a ceramic fiber in order to provide for a better sealing off of the catalyst apparatus. It is noted that between disc 12 and sleeve 3 or angular ring 11 respectively a gap is provided, therefore, the elastic effect of cushions 4 and 6 can be transmitted to the catalyst body.

The end wall portion 8, collar 9, annular ring 11 and annular disk 12 act as supporting and protecting rings and comprise a thin sheet metal.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. Device for the purification of waste gases of internal combustion engines comprising a housing having an inlet and an outlet and having at least one monolith through which the waste gases flow and which is disposed in said housing between said inlet and outlet, said at least one monolith having opposed end edges and having one compressed metallic body ring in contact with the side potions of the end edges absorbing radial forces and one compressed metallic body ring in contact with the end portions of the end edges absorbing axial forces, said rings being disposed at said end edges in contact with the housing, and supporting and protecting rings of thin sheet metal disposed between and in contact with said rings and said end portion edges.

2. Device in accordance with claim 1 where the rings in the form of compressed metallic bodies comprise wire netting.

3. In a catalyzer for detoxifying exhaust gases from an internal combustion engine, wherein a monolithic catalyst body having an outer surface and facing ends is supported in a housing having an inner surface, by support means arranged between said inner surface of said housing and said outer surface of said monolithic catalyst body, the improvement comprising said support means comprising elastically yielding means, and holding means for locating said elastically yielding means at least partially between each facing end of said monolithic catalyst body and the inner surface of said housing, whereby the monolithic catalyst body is elastically restrained in said housing against movement in all three dimensions of space, wherein said elastically yielding means are elastically deformable, heat resistant wire mesh damping rings having an inner diameter, said holding means comprising inner supporting means located in said housing for holding said rings at the respective inner diameter thereof whereby the damping rings are securely seated on the respective inner supporting means and thus between the inner housing surface and the respective facing end of the monolithic catalyst body.

4. A catalyzer as claimed in claim 3, further comprising a pair of angular ring members, one of said angular ring members applied directly to the peripheral edges of each facing end of said monolithic catalyst body between each of said facing ends and the associated elastically deformable damping ring to protect said catalyst body against relative movement against said elastically deformable damping rings during occurrence of compression forces, each of said angular ring members including an annular portion lying against the facing end of said monolithic catalyst body and a circumferential portion surrounding said catalyst body and extending axially toward the center of said catalyst body.

5. In a catalyzer for detoxifying exhaust gases from an internal combustion engine, wherein a monolithic catalyst body having an outer surface and facing ends is supported in a housing having an inner surface, by support means arranged between said inner surface of said housing and said outer surface of said monolithic catalyst body for supporting said catalyst body, the improvement comprising said support means comprising a pair of elastically deformable damping rings having an inner diameter;

holding means for locating one of said elastically deformable damping rings at least partially between each facing end of said monolithic catalyst body and the inner surface of said housing, whereby the monolithic catalyst body is elastically restrained in said housing against movement in all three dimensions of space; and a pair of angular ring members, one of said angular ring members applied directly to the peripheral edges of each facing end of said monolithic catalyst body between each of said facing ends and the associated elastically deformable damping ring to protect said catalyst body against relative movement against said elastically deformable damping rings during occurrence of compression forces, each of said angular ring members including an annular portion lying against the facing end of said monolithic catalyst body and a circumferential portion surrounding said catalyst body and extending axially toward the center of said catalyst body.

6. A catalyzer as claimed in claim 5, wherein said inner supporting means comprises a collar member extending axially into said housing from each inner end surface of said housing.

7. A catalyzer as claimed in claim 5, wherein said support means includes a first elastically deformable damping ring circumferentially surrounding the outer surface of said catalyst body and two second elastically deformable damping rings seated on said inner supporting means between the inner housing surface and the respective facing ends of said catalyst body.

8. A catalyzer as claimed in claim 7, wherein said first and second elastically deformable damping rings are integrally formed with one another.

9. A catalyzer as claimed in claim 5, further comprising a compensating and heat sealing layer comprising a heat resistant mineral fiber material surrounding the outer surface of said monolithic catalyst body.

10. A catalyzer as claimed in claim 9, further comprising a rigid sleeve surrounding said compensating and heat sealing layer over at least a portion of its length.

11. A catalyzer as claimed in claim 10, wherein said rigid sleeve is comprised as a plurality of sections.

12. A catalyzer as claimed in claim 10, wherein said rigid sleeve comprises a heat insulating mineral material.

13. A catalyzer as claimed in claim 10, wherein said rigid sleeve comprises a metal.

14. A catalyzer as claimed in claim 13, wherein said rigid sleeve includes a plurality of ribs extending in at least one of the axial or circumferential directions.

* * * * *